US008631938B2

(12) United States Patent
Roland et al.

(10) Patent No.: US 8,631,938 B2
(45) Date of Patent: Jan. 21, 2014

(54) EASY OPENING PACKAGING FOR LIQUID OR GEL PRODUCTS

(75) Inventors: Habluetzel Roland, Chavornay (CH); Hentzel Stephane, Yvonand (CH); Magniet Ines, Savigny (CH)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 13/387,460

(22) PCT Filed: Jul. 28, 2010

(86) PCT No.: PCT/EP2010/060954

§ 371 (c)(1), (2), (4) Date: May 2, 2012

(87) PCT Pub. No.: WO2011/012644

PCT Pub. Date: Feb. 3, 2011

(65) Prior Publication Data

US 2012/0211387 A1 Aug. 23, 2012

(30) Foreign Application Priority Data

Jul. 29, 2009 (EP) ..... 09166779

(51) Int. Cl.

*B65D 73/00* (2006.01)
*B65B 3/04* (2006.01)
*B65D 47/10* (2006.01)

(52) U.S. Cl.

USPC ..... 206/484; 222/541.1

(58) Field of Classification Search

USPC ..... 206/204, 207, 210, 484, 484.1, 484.2, 206/494, 532, 439; 229/212, 213, 124.52; 222/541.5, 541.1

See application file for complete search history.

(56) References Cited

U.S. PATENT DOCUMENTS 2,399,000 A * 4/1946 Carroll ..... 222/210
3,272,425 A * 9/1966 Bendersky et al. ..... 229/123.2

(Continued)

FOREIGN PATENT DOCUMENTS

| | | |
|---|---|---|
| WO | 90/00503 | 1/1990 |
| WO | 2005/075317 | 8/2005 |
| WO | 2007/073526 | 6/2007 |

OTHER PUBLICATIONS

International Search Report and Written Opinion dated Oct. 6, 2010, received in corresponding PCT Application No. PCT/EP2010/060954 filed Jul. 28, 2010.

*Primary Examiner* — Andrew Perreault
(74) *Attorney, Agent, or Firm* — Gary M. Lobel

(57) ABSTRACT

The present invention proposes a packaging (1) for a food product such as a gel comprising a first sheet (2) comprising at least one folded portion (4) of sheet material which runs across the first sheet, the sheet material in the folded portion (4) being joined together in a peelable seal (6), a second sheet (3) comprising at least one folded portion (5) of sheet material which runs across the second sheet, the sheet material in the folded portion (5) being at joined together in a peelable seal (7). The first and second sheets (2,3) are joined together defining a product cavity (8), the first and second sheets (2,3) are positioned such that two folded portions (4,5) protrude outwardly and are arranged opposite such that by pulling in a direction transverse to that of the folded portions, the two peelable seals (6,7) are peeled apart and an aperture (9,10) be created in each side of the packaging providing access to the product cavity (8). The invention also relates to a method for making such a packaging.

13 Claims, 3 Drawing Sheets

(56) References Cited

U.S. PATENT DOCUMENTS

D247,064 S * 1/1978 Spiegelberg ..... D9/416
4,807,613 A * 2/1989 Koehnke et al. ..... 602/57
5,065,863 A * 11/1991 Moyet-Ortiz ..... 206/210
6,007,264 A * 12/1999 Koptis ..... 401/132
2004/0031823 A1 2/2004 Redmond

* cited by examiner

EASY OPENING PACKAGING FOR LIQUID OR GEL PRODUCTS

FIELD OF THE INVENTION

The present invention relates to a packaging for a food product and particularly for performance gel products as well as products enclosed in such a packaging. Gel products are considered illustrative representatives of such performance.

BACKGROUND OF THE INVENTION

Packages for food products are well known from the prior art and primarily serve the purpose of conserving the freshness and taste of the packed product. Therefore, the packages are often sealed and thus impermeable to moisture and gas.

Flexible packaging material is used for liquid, gel, paste, purée etc. Typically a notch is provided in the package which allows for a tearing of the packaging material to open the package and a dispensing of the product therein. The packaging material part which has been torn to create the opening may be removed from the package and disposed off or may remain attached to the package. Usually opening of such flexible packages containing liquids or gels require two hands, one holding the package and one tearing the package. Alternatively a scissor may be used for opening the pack.

In the field of sports or performance products such are liquids or gels e.g. energy gels, amino acid gels etc., are meant to be consumed in completely different conditions than for example confectionary products. Performance gels are often consumed during training or competitions. Thus, the packaging thereof has to be opened with wet or sweaty hands, during running, during cycling etc. Thus, the packaging sometimes has to be opened with a single hand and/or using the mouth (lips or teeth). If the athletes have to carry the product it is desirable that it can be easily stored and precisely dosed. Further products high in carbohydrates are when spilled very sticky.

In the field of packaging, upright pouches exist which comprising vertical running folds of packaging material joined by peelable seal. By pulling in the package transversal to the peelable seal in a horizontal manner, the seal opens into one aperture in the top of the package. The opening of these pouches requires the grip of two hands which makes them inconvenient for sports or performance products. Further, the dosing of the product from the aperture is hard to control.

There is therefore a need for an easy opening package of flexible material which can be used in sports or performance. Further, there is a need for a package, which allows for a precise dosing of the product and prevent spillage.

Preferably the opening of the packaging should maintain the packaging as one coherent piece in order to avoid littering of smaller pieces of the packaging material.

The present invention seeks to address the above-described problems. The invention also aims at other objects and particularly the solution of other problems as will appear in the rest of the present description.

OBJECT AND SUMMARY OF THE INVENTION

In a first aspect, the invention provides a packaging for a food product such as a gel comprising a first sheet comprising at least one folded portion of sheet material which runs across the first sheet, the sheet material in the folded portion being joined together in a peelable seal, a second sheet comprising at least one folded portion of sheet material which runs across the second sheet, the sheet material in the folded portion being joined together in a peelable seal, the first and second sheets are joined together defining a product cavity, the first and second sheets are positioned such that two folded portions protrude outwardly and are arranged opposite such that, by pulling in a direction transverse to that of the folded portions, the two peelable seals are peeled apart and an aperture be created in each side of the packaging providing access to the product cavity.

It has been found that this flexible package has similar advantages as sports bottles with caps push-pull closure valves. These bottles are opened by pulling up the cap to open the valve. A similar movement can be done by the consumer by holding the flexible package with one hand and pulling with the teeth or lips. Hence, a consumer may easily open the packaging e.g. on a bike or when running.

The aperture defines a controlled opening via the folds.

With a sealed package according to the present invention, a food product can be effectively protected against environmental influences such as humidity or gas in order to enable a long stability upon storage of the food product.

The packaging material is preferably made from plastics, paper or metal foil or compound foils thereof known in the field of packaging of food products.

In the packaging, the first and second sheets are positioned such that two folded portions protrude outwardly and are arranged opposite. It is preferred that the base of the folded portions are substantially abutting where the folded portions extends from the main sheet plane. This allows for an easy peeling of the seals between within the folded portions of the sheet material.

In a preferred embodiment, the package comprises a top part and a bottom part and the opening of the package can be done by vertically pulling the top part away from the bottom part. Advantageously, the top part comprises a neck portion to ease emptying of the product from the packaging. The folded portions with the peelable seals are preferable in the neck part to allow opening of the package into two apertures on the side of the neck part.

In a particular advantageous embodiment of the invention for sport nutrition products the neck part of the packaging is designed to be pulled with teeth or mouth, and the design thereof is adapted to be put into the mouth for emptying. This make it particular convenient for usage with wet or sweaty hands, during running, during cycling etc. The width of the neck part is preferably from 10 to 50 mm, preferable from 10 to 30 mm.

At the bottom part of the package may advantageously be provided with a base formed from the sheet material created by a folding on the sheet material.

In order to get a good emptying of the product from the package, the folded portions have a depth (14) from 5 to 20 mm, preferably 5 to 10 mm, from the respective sheets plane. This give is an appropriate aperture size for emptying of a gel food product having a viscosity range of 0.5-1.5 Pa·s at 25° C.

In a one embodiment, sealing of the packaging is obtained by a sealing film which is used on its own or added to other layers of packaging material. Thereby, the sealing film is preferably a heat-sealable peelable film comprising thermoplastic material such as polyolefin.

In a preferred embodiment, the heat-sealable film is a co-extruded film. The co-extruded film comprises a bulk layer of relatively inexpensive resin material and a thinner peelable sealant layer. The bulk layer provides a cushioning effect when sealing and gives the film a body. This has the advantage that the thickness of the peelable film can be adjusted to meet the particular packaging needs. Moreover, the co-extruded film can then be laminated to other layers of the packaging material. Accordingly, the barrier and/or printing properties can be enhanced.

In general, the co-extruded heat-sealable film may be designed to enable an adhesive or cohesive peel thereof. Thereby, depending on the choice of the used resin materials, durability and barrier properties of the sealing are enhanced.

It should be understood that instead of a heat-sealable co-extruded peelable film, a heat-sealable coating or a cold seal adhesive e.g. on acrylic basis may be applied in order to enable effective sealing of the packaging. This is a desirable sealing should highly reliable tightness of the packaging be desired.

In a second aspect, the invention proposes a method as described in the claims.

It should be understood that the packaging and the method for packing according to the present invention are not limited to be applied to gel or liquid products but may useful for other type of products such as paste, granular, powders etc.

The flexible packaging material may be with or without barrier properties. If barrier properties are needed, a barrier layer could be either an aluminium foil, or a metallised foil, or a specific barrier material such as EVOH or AluOx (aluminium Oxide)/SiOx (silicium oxide).

BRIEF DESCRIPTION OF THE DRAWINGS

Further features, advantages and objects of the present invention will become apparent for the skilled person when reading the following detailed description of embodiments of the present invention, when taking in conjunction with the figures of the enclosed drawings.

DETAILED DESCRIPTION OF EMBODIMENTS

Figure 1:
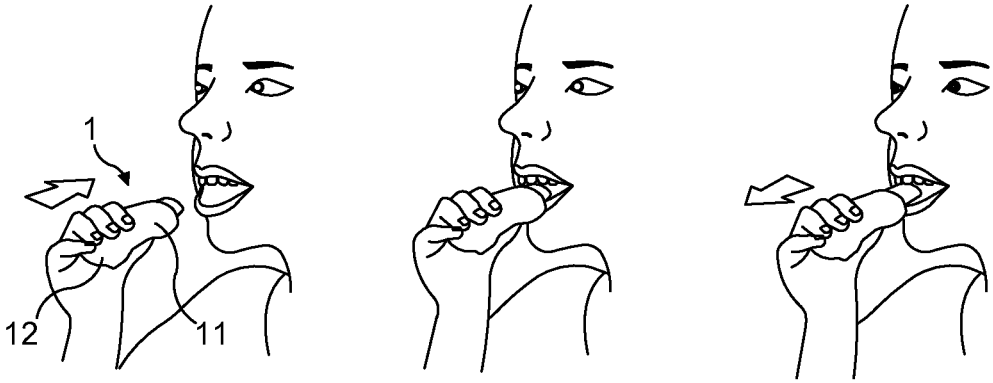
FIG. 1 shows a drawing of how one intuitively open the packaging of the invention can be opened like a sports bottle.

In FIG. 1 it is shown how a consumer intuitively can open the packaging of the invention. The movements are the same as used when opening sports bottle with valves in the cap. The packaging comprises a top part (11) and a bottom part (12). The consumer utilises one hand and the teeth to pull in a direction transverse to that of the folded portions. This moves the top part (11) and a bottom part (12) apart. The two peelable seals in the side portions are thus peeled apart and an aperture is created in each side of the packaging providing access to the product cavity. The product is then dispensed directly into the mouth by squeezing the packaging, providing a convenient and easy way to consume the product.

Figure 2:
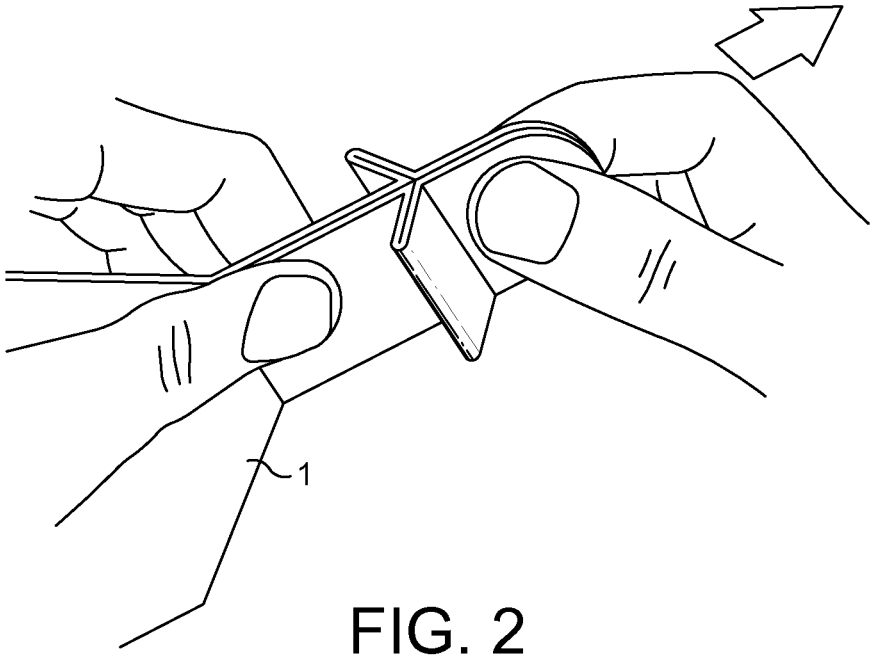
FIG. 2 shows a drawing of the opening of the packaging according to the invention.

FIG. 2 shows opening of the packaging (1) according to the invention with two hands.

Figure 3:
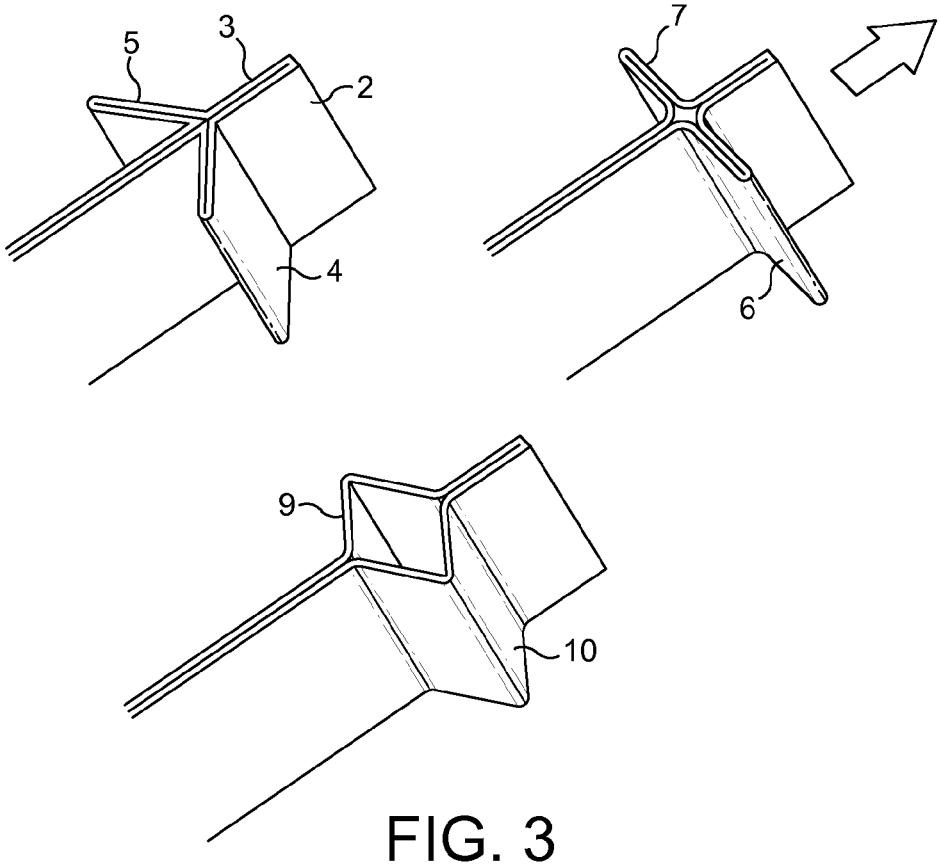
FIGS. 3 to 6 show drawings of details the packaging.
Figure 4:
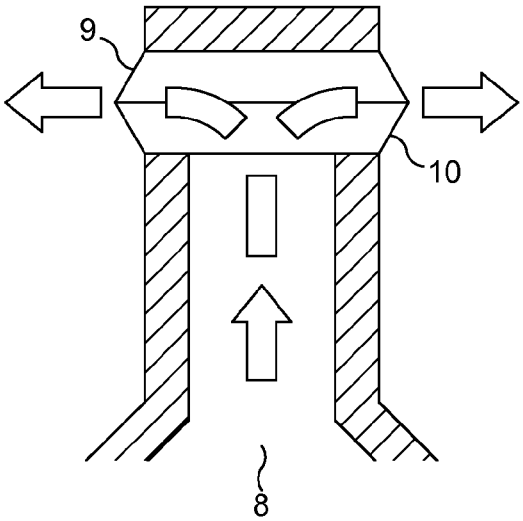

FIG. 3 shows detailed view of the packaging. A first and second sheets (2,3) which are positioned such that two folded portions (4,5) protrude outwardly and arranged opposite such that. By pulling in a direction transverse to that of the folded portions, two peelable seals (6,7) are peeled apart and an aperture (9,10) is created in each side of the packaging providing access to the product cavity (8). FIG. 4 is a schematic drawing illustrating the flow of the product from the product cavity (8) though the two apertures (9,10) upon opening of the packaging.

In a preferred embodiment of the method according to the invention, the packaging is made as follows:

A first sheet (2) and a second sheet (3), are provided with one folded portion (4) of sheet material which runs across the first sheet (2), and folded portion (5) of sheet material which runs across the second sheet, see FIG. 3. More folded portions may be provided if more than one whole in each side of the packaging is desired. The positioning the first and second sheets (2,3) is such that the two folded portions (4,5) protrude outwardly and the folded portions (4,5) arranged opposite. Preferable this is done by means of two pair of sealing tools, which are moved to engage with the sheets (2,3) to create the folded portions (4,5) and provide peelable seals (6,7). Furthermore, an optional step of folding down the folded portion to ease joining of the first and second sheets (2,3) together, may be performed.

Figure 5:
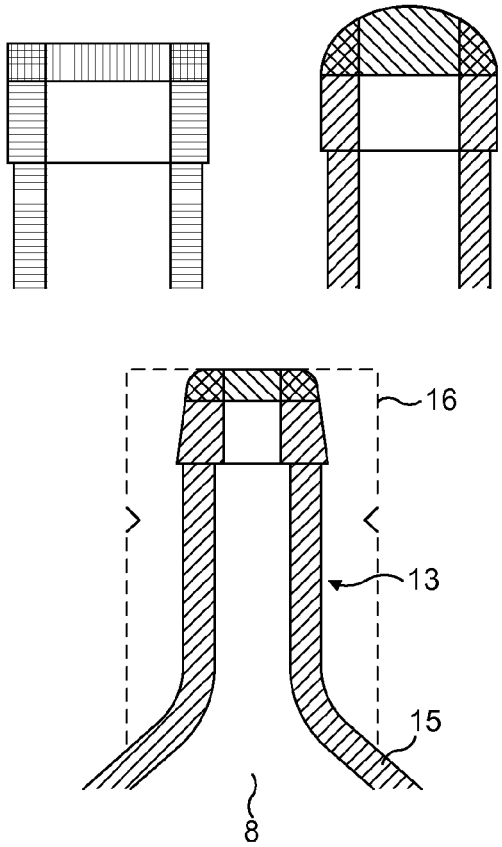

For the creating of the product cavity (8) sealing tools are brought into contact with the sheets (2,3) in order to seal a rim (15) of the package and thereby forming product cavity (8). Product can be filled into the product cavity (8), by means of a dosing device. The product cavity (8) is then sealed off. Subsequently, the forming of a neck part (13) in the packaging is done with a shaped forming tool. The neck part (13) is cut out with a shaped cutting tool. FIG. 5 shows the sealed rim (15) in the neck part (13), and the outline of the sheet material (16) prior to the cutting out of the neck part (3). A packaging according to the invention is thus provided.

The first and second sheets are preferably joined by sealing with heat wending or glued. For sealing with heat welding it is preferred that the packaging is a Form, Fill and Seal packaging machine. Advantageously such a packaging machine is a horizontal HFFS or vertical VFFS Form, Fill and Seal packaging machine.

Figure 6:
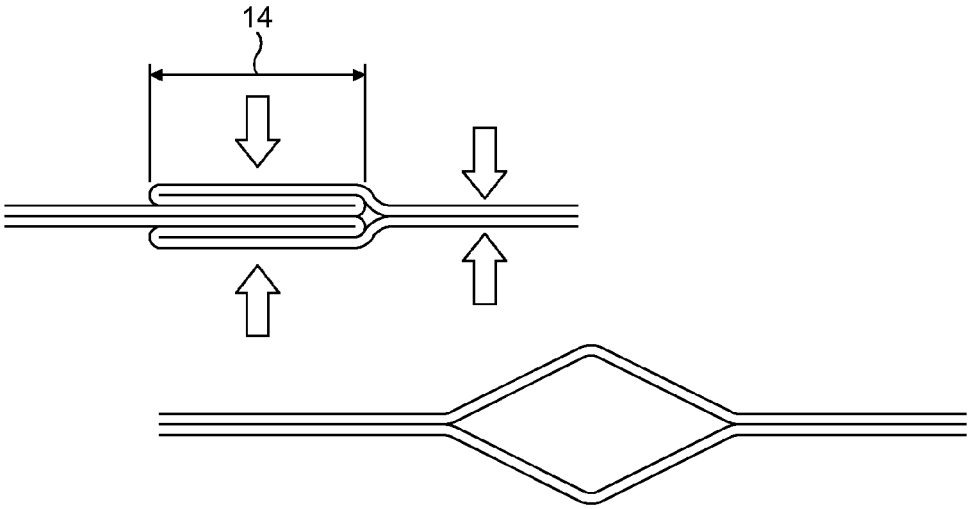

FIG. 6 is a side view of the folded portions of the sheet (6,7) in a closed and opened position. The folded portions have advantageously a depth (14) from 5 to 20 mm, preferably 5 to 10 mm, from the respective sheets plane. This provides a good opening for dosing of a gel or liquid product. The dimensions of the folded portions may be adapted to the type of product to be dosed.

The invention claimed is:

1. A packaging for a food product such as a gel, the packaging comprising:

a first sheet comprising at least one folded portion of sheet material which runs across the first sheet, the sheet material in the folded portion being joined together in a peelable seal;

a second sheet comprising at least one folded portion of sheet material which runs across the second sheet, the sheet material in the folded portion being joined together in a peelable seal;

the first and second sheets are joined together defining a product cavity; and the first and second sheets are positioned such that two folded portions protrude outwardly and are arranged opposite such that, by pulling in a direction transverse to that of the folded portions, the two peelable seals are peeled apart and an aperture created in each side of the packaging providing access to the product cavity, wherein the packaging comprises a top part comprising a neck portion having a width from about 10 mm to about 50 mm, and wherein the folded portions have a depth from 5 to 20 mm from the respective sheets plane.

2. The packaging of claim 1, wherein the packaging comprises a bottom part and opening of the packaging can be done by vertically pulling the top part away from the bottom part.

3. The packaging of claim 1, wherein the folded portions with the peelable seals are in the neck portion to allow opening of the package into two apertures on the side of the neck portion.

4. The packaging of claim 1, wherein the width of the neck portion is from 10 to 30 mm.

5. The packaging of claim 4, wherein the neck portion of the packaging is designed to be pulled with teeth or mouth, and the design thereof is adapted to be put into the mouth for emptying.

6. The packaging of claim 1, wherein the bottom part of the package is provided with a base formed from the sheet material.

7. The packaging of claim 1, wherein the packaging is formed from flexible material.

8. The packaging of claim 7, wherein the flexible material is a multi-layer material.

9. The packaging of claim 1, wherein the first and second sheet are joined together by glue or seal heat welding.

10. A method for providing a packaging for a food product such as a gel, the method comprising:

providing a first sheet and a second sheet;

folding the first sheet to provide at least one folded portion of sheet material which runs across the first sheet;

folding the second sheet to provide at least one folded portion of sheet material which runs across the second sheet;

joining the sheet material in every folded portion together with a peelable seals;

positioning the first and second sheets with two folded portions protrude outwardly and the folded portions arranged opposite; and joining the first and second sheets together and forming a product cavity, wherein the packaging comprises a top part comprising a neck portion having a width from about 10 mm to about 50 mm, and wherein the folded portions have a depth from 5 to 20 mm from the respective sheets plane.

11. The method of claim 10, further comprising a filling device fills the product into the product cavity; and sealing off the product in the product cavity.

12. The method of claim 10, comprising:

forming a neck portion in the packaging with a shaped forming tool and the neck portion is cut out with a shaped cutting tool.

13. A food product contained within a packaging, the packaging comprising:

a first sheet comprising at least one folded portion of sheet material which runs across the first sheet, the sheet material in the folded portion being joined together in a peelable seal, a second sheet comprising at least one folded portion of sheet material which runs across the second sheet, the sheet material in the folded portion being joined together in a peelable seal, the first and second sheets are joined together defining a product cavity, the first and second sheets are positioned such that two folded portions protrude outwardly and are arranged opposite such that, by pulling in a direction transverse to that of the folded portions, the two peelable seals are peeled apart and an aperture created in each side of the packaging providing access to the product cavity, wherein the packaging comprises a top part comprising a neck portion having a width from about 10 mm to about 50 mm, and wherein the folded portions have a depth from 5 to 20 mm from the respective sheets plane.

* * * * *